US005624177A

United States Patent [19]

Rosaia

[11] Patent Number: 5,624,177

[45] Date of Patent: Apr. 29, 1997

[54] I.C.B. ILLUMINATING UNITY RING FOR DRINKING GLASS

[75] Inventor: Kirk S. Rosaia, Burlingame, Calif.

[73] Assignee: Joseph Carrabino, Brisbane, Calif.

[21] Appl. No.: 392,031

[22] Filed: Feb. 22, 1995

[51] Int. Cl.[6] ..... F21V 33/00

[52] U.S. Cl. ..... 362/101; 362/800; 362/806; 362/154; 362/205

[58] Field of Search ..... 362/101, 802, 362/96, 276, 154, 806, 205, 295

[56] References Cited

U.S. PATENT DOCUMENTS

| | | | |
|---|---|---|---|
| 2,224,319 | 12/1940 | Schroyer | 362/101 |
| 3,878,386 | 4/1975 | Douglas | 362/101 |
| 4,336,574 | 6/1982 | Goodman | 362/101 |
| 4,344,113 | 8/1982 | Ditto et al. | 362/155 X |
| 4,858,084 | 8/1989 | Sheryll | 362/101 |
| 4,922,355 | 5/1990 | Dietz et al. | 362/101 |
| 5,119,279 | 6/1992 | Makowsky | 362/101 |
| 5,211,699 | 5/1993 | Timpton | 362/101 |
| 5,339,548 | 8/1994 | Russell | 362/101 X |

*Primary Examiner*—Denise L. Gromada
*Assistant Examiner*—Thomas M. Sember

[57] ABSTRACT

An illuminated circular ring which provides lumination to various style drinking glasses. This ring being attachable or interdesigned into various style drinking glasses providing a housing for a integrated circuit board with state of the art surface mount solid state components. The components being attached to an interchangeable cover. This ring being considerably narrower than prior art; and works particularly well with a long completely hollow stem high foot champagne style glass. A glass in which the colored light gives to the bubbles of champagne or sparkling beverages a specially pleasing effect. All in a appropriate lightweight state of the art design.

11 Claims, 5 Drawing Sheets

UNITY RING

OVER HEAD VIEW

CROSS SECTION VIEW

ENLARGED DETAIL

IC.8.
RETAINMENT DISK AND COVER

I.C.B. ILLUMINATING UNITY RING FOR DRINKING GLASS

BACKGROUND OF THE INVENTION

This invention relates generally to a drinking glass. More particularly, the invention relates to a glass adapted to be filled with a beverage and being provided with an electrical circuitry producing a lighting effect through the beverage.

Various types of illuminated drinking glasses have been described in the patent literature. For example, U.S. Pat. No. 919,691 to Cahill describes an illuminated drinking glass comprising a bowl having a stem and a tube which can be easily removed from the glass, the lighting being provided by an incandescent lamp bulb. U.S. Pat. No. 2,177,337 to Stein discloses a holder for a tumbler which can be easily detached therefrom and comprising an electrical circuitry including a button spring cylinder switch. U.S. Pat. No. 2,224,319 to Schroyer teaches an illuminated drinking vessel supported by a hollow base which is detachable therefrom and having an electric lamp as well as a push-button switch. U.S. Pat No. 2,532,181 to Moore describes an illuminated drinking glass adapted to be detachably received into the upper end of a hollow stem and comprising a coil spring for urging the battery upwards to contact an electric lamp. U.S. Pat. No. 2,663,866 to Simpson discloses a drinking glass comprising an illuminated bottom attachment which can be separated therefrom and containing electrical components including a battery and a lamp set in a socket. U.S. Pat. No. 3,218,447 to Pardue teaches a drinking glass comprising a conical glass secured to a metallic stem which contains electrical elements including a battery, a mercury switch and a conventional light bulb connected thereto. U.S. Pat. No. 3,374,344 to Rudolph et al describes a beverage glass comprising a shell removable mounted on a stem containing electrical components including a light bulb and a rotating switch to turn the light on and off. U.S. Pat. No. 3,878,386 to Douglas a lighted beverage glass which is removable from a stem assembly comprising a conventional electric bulb which is lighted by turning a rotating switch knob. U.S. Pat. No. 4,344,113 to Ditto et al shows an apparatus to illuminate a liquid drink comprising a glass receptacle adapted to fit on a base containing electrical components including a coil, a diode, two batteries, a switch and a light bulb.

While the aforementioned patents disclose various concepts of lighted drinking glasses, however, there are certain differences in the structure of my glass and in the electric circuitry and that of prior above noted art.

Therefore, I believe that I should be entitled to patent protection on the specific combination of elements in my glass which is not shown in any of the above patents. I wish to proceed with a formal patent application.

OBJECTS OF THE INVENTIONS

In view of the foregoing, it is the principal object of this invention to provide a new ornamental illuminating glass for use in drinking various kinds of sparkling beverages. Another object of the invention is to provide a novel transparent drinking glass constructed from a unitary body characterized by a colorful and decorative appearance when illuminated.

Still another object of the invention is the provision of a one-piece watertight glass containing a simple electrical circuitry which provides an appealing lighting effect to a sparkling beverage contained in the glass.

An even further object of the invention is to provide an illuminating drinking glass which can be manufactured easily in large quantities at a relatively low cost from readily available materials.

These and other objects of the invention will become fully apparent from the following description taken in conjunction with the accompanying drawings.

BRIEF SUMMARY OF THE INVENTION (A) This invention must start at the unique base at the foot of illuminating drinking glass. The base is what differentiates this illuminated drinking vessel (Glass) from all discovered prior art of this subject. See accompanying drawing FIG. (1).

(B) This base is actually a circular ring. This ring I am naming as a "Unity Ring". It is called a Unity Ring for the fact that it unites the above (16) glass drinking vessel to the below (14) circuit board retainment cover.

(C) Now I'll go into more detail of this Unity Ring. The shape is circular with the diameter slightly more than that of the foot of the drinking vessel, with a height of not more than (6.24 mm) centimeters. This ring may have a slight furrow (10) around the upper arch of the ring on the inside track, for glue or any suitable sealing compound capable of providing a lasting and firm bond or as an attachable (permanent) piece of the base design.

The ring may be made right on the foot of the glass in which case the furrow will not be needed.

The rings outer (17) wall is curved like a back to back bullnose shape. This shape is called a double bullnose by the tile and marble trade and describes an edge finish. As the line for the outer shape of the ring comes around to the underside of said ring there is a slightly angled inward recess (6) step with a depth of approximately ½ of a (M.M.). This steps up to a (20) platform. This platform extends approximately 1 (M.M.) horizontally to the rings (21) interwall The angled inward step and platform hold the removable (14) circuit board retainment disk/cover.

This interwall connects the upper portion of the rings design to the lower portion of the rings design by the (22) inter wall line which connects the glue furrow and the platform line. This line thus completes the design for a complete ring. The thickness <0f this ring at approximately 6.24 mm and truly differentiates this base for illumination over all discovered prior art. This ring will illuminate when made of a translucent material.

The ring may be made with, but not limited to the following materials: glass, plastic, acrylic, polycarbonate, lexan, ceramic or metal. The ring forms a housing frame for all electrical components under the foot of the drinking vessel. This finishes the description of Unity Ring. Now, I describe some observations of the rings benefits over prior art.

(1) The thin ring design lends itself to adapt to the foot of many style glasses.

(2) The ring design uses the least amount of material and the ring is most economical to produce of all the designs studied of prior art. I see a simple 2 piece multi-cavity die made for injection mold which can easily produce a few parts or a million parts at a very low per piece cost (3) The rings recess step for the I.C.B. cover retainment disk allows user to snap on and off a variety of lighting options. Such as different color light, blinking, dimming, continues all at the snap of a different disk. The blinking and timed off LED extend the life of the battery.

Although the uniqueness of the ring will be obvious to a layman skilled in the making of light glasses, this unique ring would not be achievable at the thickness or better stated for appropriateness "its thinness" of design, without the technologically advanced electrical components contained within the ring.

BRIEF DESCRIPTION OF THE DRAWINGS

For a fuller understanding of the nature and objects of the invention, reference should be made toe the following drawings.

DESCRIPTION OF THE PREFERRED EMBODIMENT

The board is of common circuit board material with a thickness of approximately (½) M.M. Each glass' board is 25 mm by 45 m.m. by 25 m.m. by 45 m.m. This etched integrated circuit board not only eliminates any use of wires by use of etched circuit lines, but the I.C.B. facilitates the use of automated pick and place manufacturing technology. Each glass' board come from a mother board which is designed in dimensions for use by automated feed, of mother board through etch solution, etch bath scoring machines pick and place machines then wave soddering machine. These mother boards hold exactly '70' individual boards. They are easily snapped apart along their score lines. The mother boards are tested at the circuit board M.F.G. Plant by a testing circuit. There are no wasted materials and is designed for high volume production.

This rectangle shape individual board has a permanently placed (by sodder) L.E.D. in approximately the center of the board. This L.E.D. is the component of light. L.E.D. is the abbreviate term for Light Emitting Diode. The L.E.D. that I use is very recent technology just introduced in late 1994 by the Hewlett Packard Corporation. They call this supper bright L.E.D. (Transparent Substrate AllnGap L.E.D. Technology). L.E.D. description: these light emitting diode are untinted, non diffused, solid state lamps, utilizing the newly developed transparent substrate aluminum Idium gallium phosphide. (T.S. AllnGap) L.E.D. Technology. This material has a luminous efficiency for producing visible light, that far exceeds an incandescent lamp, and is capable of producing high light output over a wide range of drive currents with far less power consumption. A luminous intensity M.C.D. @ 20 MA is 6,500 typ. for the L.E.D.

These L.E.D.'s make my glass brighter for longer with less mounting space required. There are far more reliable than any type of gas filled bulb and consume far less energy. All of these facts of the LED allowed for the design of an I.C.B. and a low profile ring style base for the drinking glass.

On the board to one side of the L.E.D are several small surface mount components. They are a surface mount compositor, resistors and a a chip. On the opposite side of the L.E.D. is a removable battery held to I.C. board by a fixed conducting battery retainment clip. All these components are soddered to the board through automated wave soddering technology accept for the removable battery for obvious reasons. The components are electrically connected by the boards etched trace line conduits. This completes the description for the upper side of I.C. Board.

Figure 4A:
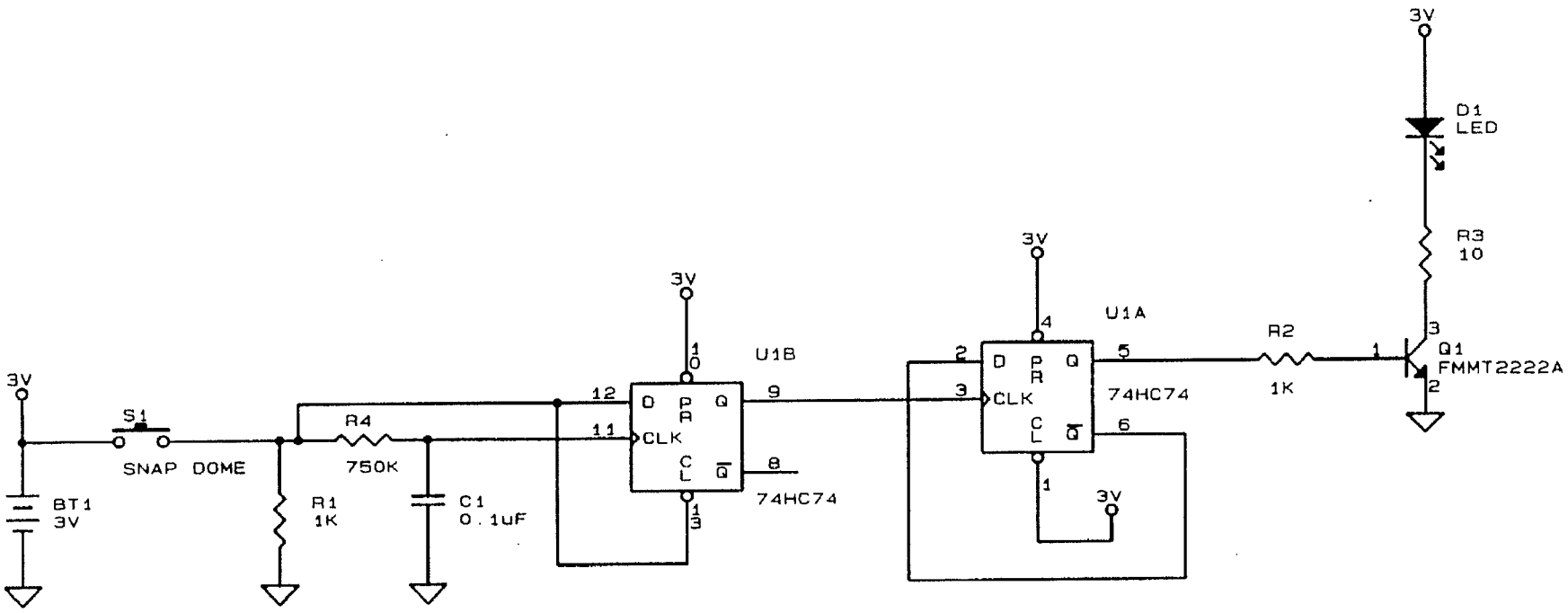
FIG. 4*a* is a detailed circuit view of the I.C.B.
Figure 4B:
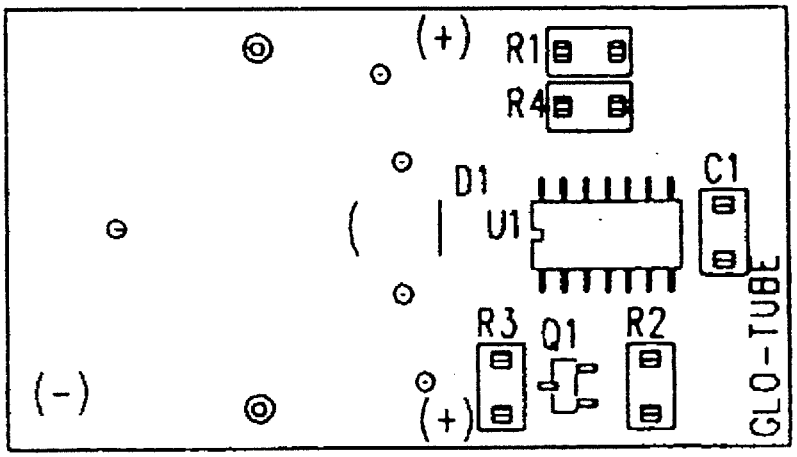
FIG. 4*b* is an overhead view of the I.C.B. electrical components and placement holes.
Figure 4C:
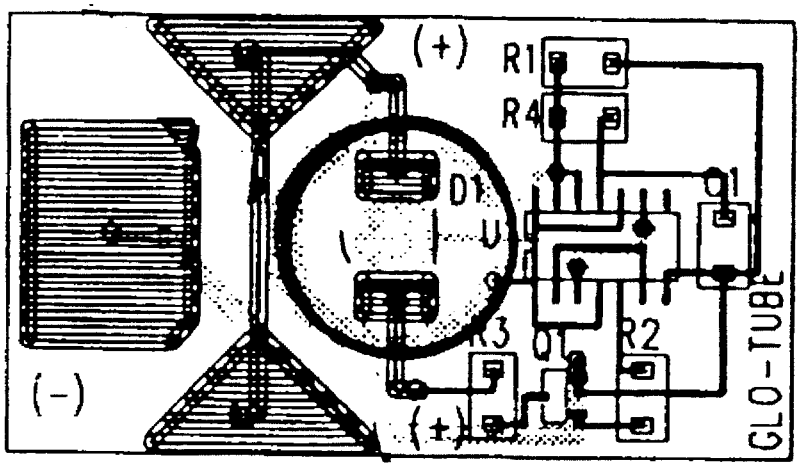
FIG. 4*c* is an underside view of the circuit board with a dome snap assembly in place.

Description of the underside of the board: On this side of the board there is etched 14.25 m.m. in diameter a partially circle with a solid 4.73 m.m. dot (see FIG. 4*c*). Joining by conductivity these together create an open circuit. To accomplish this there is, sealed to the circle, a dome snap of the same diameter as etched conductor circle. The dome snap, known to those (familiar) in micro-electronic art is variable by type, touch sensitive membrane component which is used to complete a circuit, monuntary. This circuit stays open or closed by the flip flop integrated circuit on the top side of the board (see FIG. 4B detail (13) which fully describes the touch sensitive membrane switched and complete the I.C. Board description.

Figure 1:
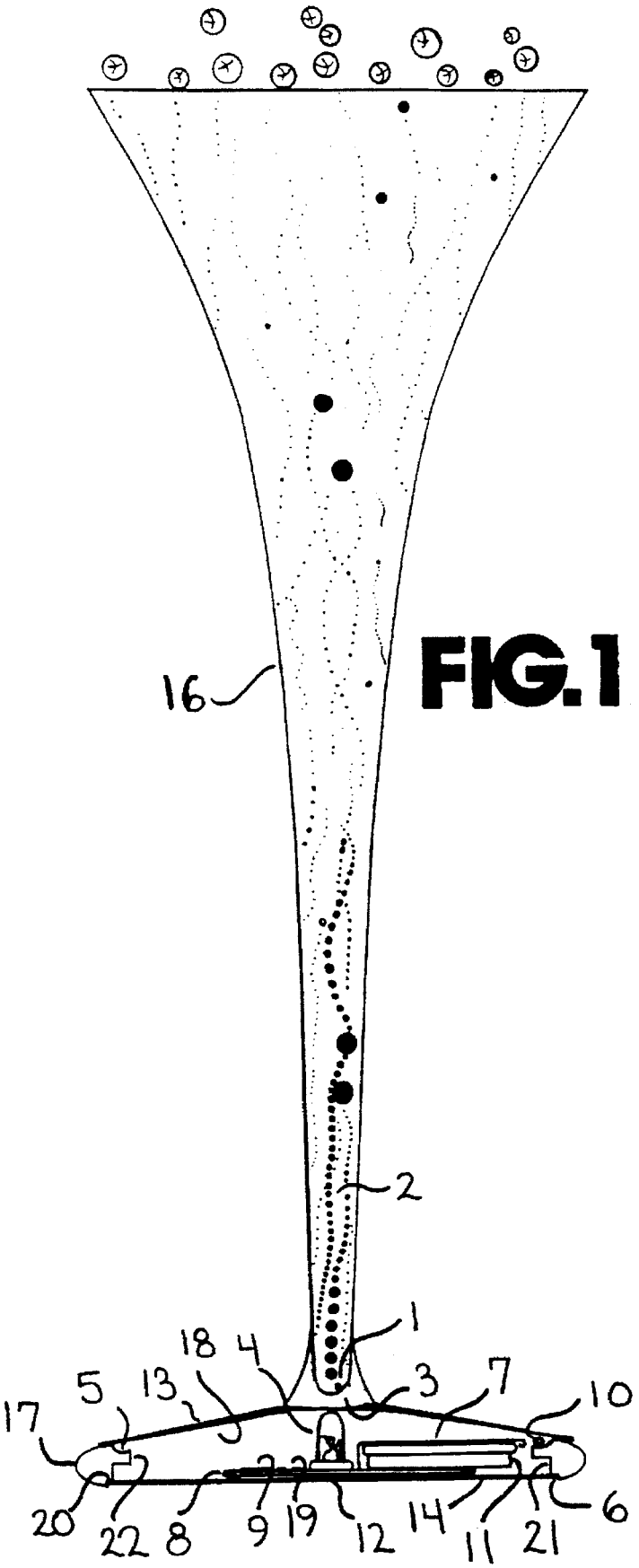
FIG. 1 is a vertical sectional view of the drinking glass and unity ring of the present invention.
Figure 2:
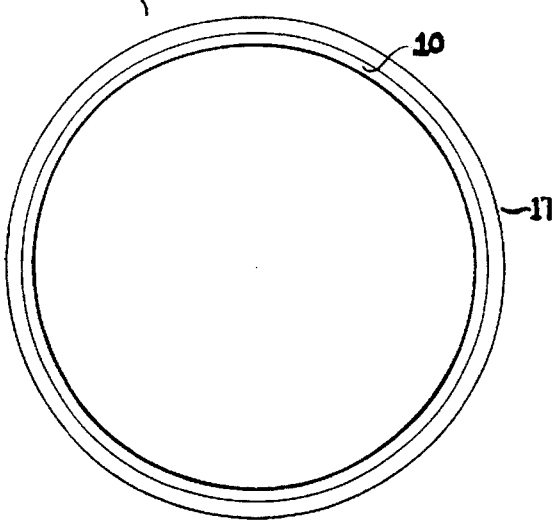
FIG. 2 is an overhead view of the unity ring of the present invention.
Figure 2B:
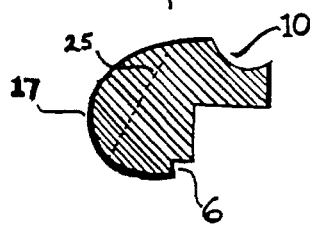
FIG. 2*b* is an enlarged detail of the cross-sectional view of FIG. 2*a*.
Figure 2A:
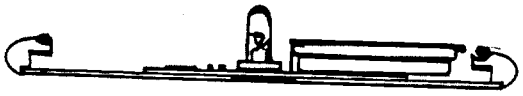
FIG. 2*a* is a cross-sectional view of the unity ring.
Figure 3:
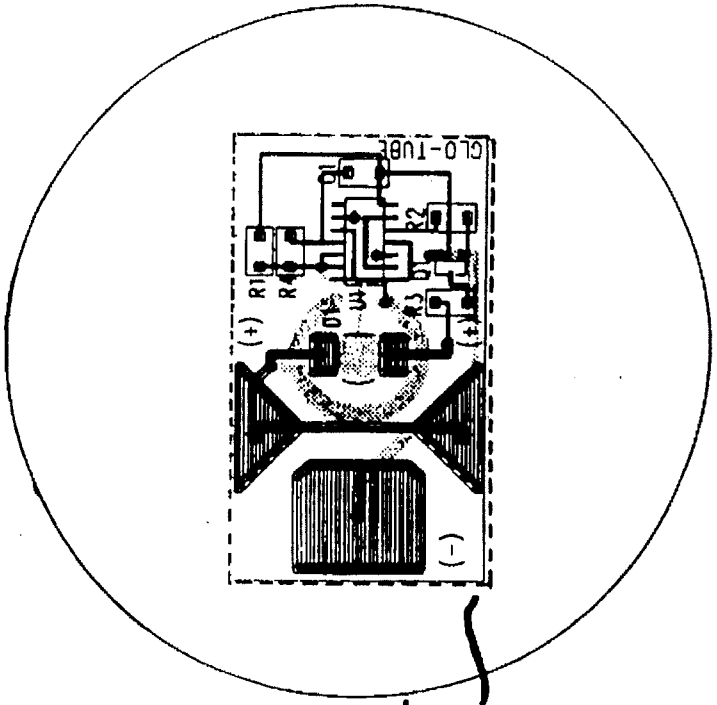
FIG. 3 is an underside view of the retainment disk and cover.

This I.C. board is attached to the (14) removable cover for for I.C.B. retainment disk (see drawing FIG. 1 and FIG. 3). There is a small (not shown) pry grove on edge of this disk to ease removal of disk from its seated position while in place on the unity ring. The circular disk provides retainment by heat sinks or glue of all electrical components with the underside providing the (14) cover for said components and completing the lower side of the unity rings housing.

This completes the description of the I.C. Board retainment disk cover.

Now That the Housing of Unity Ring and attached circuitry has been described, I will go into more detail of the preferred glass to be illuminated. Refer to drawing FIG. 1, detail (16), the glass shows as described, a hollow long stem champagne flute, also known by some in the industry as a trumpet glass. While dimension or capacities of glass are not critical, and the upper portion of the design of the glass may be of any design of known or unknown shape used for a drinking vessel. Although a long hollow stem flute is preferred, the benefit of a long stem gives the bubbles of a sparkle type beverage longer time to "play" on the light within the glass; this creates a visually more appealing effect. The sides of the glass may be etched or cut for effect. The light will travel the glasses wall into said effects giving them illumination.

Description of the foot of the preferred glass: It is to be a high foot as known in the art of table glassware with the center of the glass higher than the outer edge of the foot. The height may be (8.6) m.m. or more from center of glass' underside to a flat surface. This minimum height of the foots center is a key aid to the low profile of the unity ring for the (18) slight arch in the foot partially accommodates the L.E.D. package which is required for illumination. The glass may be (see FIG. 1) detail (13) opaque coated in gold/silver colors or frosting of glass from where the stem begins upward on the outer surface, to a parallel line where the stem begins upwards on the underside. This is to conceal view of inter compartment of glass but is not necessary. The center of the glass (3) is clear for passage of the L.E.D. light.

If the foot of the glass is opaquely coated with the preferred shinny gold, this now shinny surface helps bounce light through the unity ring for an even brighter ring; giving an additional, more appealing effect in a low lit room. The glass may have a very small spot etched on the drinking sides lower portion near the center of the foot. This etched spot I call it "bubble enhancment". See FIG. 1 #(1). The etched spot helps release more bubbles and nearer to the center of light. This intensifies the whole effect even more. This is a complete description of the glass, and now with the other complete descriptions of components, a complete description of my I.C.B. Illuminating Ring and Drinking Glass.

It should be apparent from the description that I have devised an improved, unitary, ornamental, illuminating drinking glass characterized by a new combination of structural elements and a simple electronic circuit "devoid of incandescent lamp." Such combination of elements provides effectively its basic function and the desired result.

The glass of this invention is particularly suitable for use in social events, parties, nightclubs, restaurants and the like establishments where beverages, especially of the sparkling type, are served as it provides a pleasantly glowing illumination to its liquid contents and creates a colorful appearance when lights in the room are dimmed.

It will be understood that various modifications in the form or in the constructional details of my invention as herein described may be made without departing from the spirit thereof or the scope of the claims which follow.

I claim:

1. An illuminated drinking glass comprising:

a ring having an upper recessed circumference and a lower angular recessed circumference, said upper recess slightly greater than an outer circumference of a drinking glass foot, said drinking glass foot fitted into said upper recess;

a snap on integrated circuit board including a light source located at a center of said circuit board, said circuit board fitted into said lower angled recess, wherein said light source transmits light into said glass foot;

a retainment disk engaged below said circuit board in the lower recess, said disk defining an underside of said glass foot and adapted to cover and hold said circuit board in place.

2. An illuminated drinking glass of claim 1, including glue furrow in said upper recess to hold said ring on glass foot.

3. An illuminated drinking glass of claim 1, wherein said ring is made of a translucent material.

4. An illuminated drinking glass of claim 1, wherein said light source is an LED.

5. An illuminated drinking glass of claim 1, wherein said lower recess includes a groove which facilitates the removal of said retainment disk.

6. An illuminated drinking glass of claim 1, wherein said circuit board holds a battery with a retainment clip.

7. An illuminated drinking glass of claim 1, wherein said drinking glass is a champagne glass and includes a bubble enhancement etched inside the champagne glass.

8. An illuminated drinking glass of claim 1, wherein said circuit board includes a touch activated switch at a bottom of the circuit board.

9. An illuminated drinking glass of claim 1, wherein said circuit board includes a snap dome on an underside of said circuit board.

10. An illuminated drinking glass of claim 1, wherein said glass foot is opaque for concealment of said integrated circuit board.

11. An illuminated drinking glass of claim 1, wherein said glass foot is illuminated when said underside of said glass foot is lightly touched by a user.

* * * * *